US006942533B1

(12) United States Patent
Parsons

(10) Patent No.: US 6,942,533 B1
(45) Date of Patent: Sep. 13, 2005

(54) FLOATING ALUMINUM BOX TO PROTECT DOCK WORKERS

(76) Inventor: Roger T. Parsons, HC 64, Box 240, Ashford, WV (US) 25009

( * ) Notice: Subject to any disclaimer, the term of this patent is extended or adjusted under 35 U.S.C. 154(b) by 0 days.

(21) Appl. No.: 10/849,886

(22) Filed: May 21, 2004

(51) Int. Cl.[7] ..... B63C 9/00; B63B 59/02
(52) U.S. Cl. ..... 441/80; 114/219
(58) Field of Search ..... 441/1, 21–29, 441/32, 80; 114/219, 263, 292, 356; 405/212; 52/503, 505; 138/106, 107; 293/1

(56) References Cited

U.S. PATENT DOCUMENTS

| | | | | |
|---|---|---|---|---|
| 3,267,498 | A * | 8/1966 | Pearson, Jr. | 441/6 |
| 3,338,254 | A * | 8/1967 | Regal | 137/68.13 |
| 3,785,312 | A | 1/1974 | Schneider | |
| 4,063,526 | A * | 12/1977 | Ueda | 114/220 |
| 4,106,144 | A | 8/1978 | Chabot | |
| 4,320,913 | A * | 3/1982 | Kuroda | 293/120 |
| 4,435,165 | A | 3/1984 | Johnson | |
| 4,517,911 | A | 5/1985 | Seefeld | |
| 4,538,663 | A | 9/1985 | Looker | |
| 4,926,781 | A | 5/1990 | Bauer | |
| 5,058,522 | A | 10/1991 | Bauer | |
| 5,269,248 | A * | 12/1993 | Lee | 114/219 |
| 5,290,196 | A | 3/1994 | Steel | |
| 5,853,264 | A | 12/1998 | Treveloni | |
| 6,146,218 | A | 11/2000 | White | |
| 6,199,797 | B1 | 3/2001 | Brown | |
| 6,234,098 | B1 | 5/2001 | Biedenweg et al. | |
| 6,273,774 | B1 | 8/2001 | Warzecha | |
| 6,289,836 | B1 * | 9/2001 | Tellex | 114/219 |
| 6,413,134 | B1 | 7/2002 | Wahl et al. | |
| 2002/0022417 | A1 | 2/2002 | Wahl et al. | |

* cited by examiner

*Primary Examiner*—Andrew D. Wright
(74) *Attorney, Agent, or Firm*—Richard C. Litman

(57) ABSTRACT

The floating aluminum box to protect dockworkers is an aluminum cube with each side being approximately eighteen inches long. The floating aluminum box is watertight and made of one-quarter inch thick aluminum plate and of welded construction. The floating aluminum box has a front, back, two sides, a top, and a bottom. The floating aluminum box has an internal support structure having two concentric aluminum pipes and a plurality of bracing plates that extend from the pipes to the sides of the cube. The floating aluminum box is also equipped with a handle and eye brackets.

11 Claims, 4 Drawing Sheets

FLOATING ALUMINUM BOX TO PROTECT DOCK WORKERS

BACKGROUND OF THE INVENTION

1. Field of the Invention

The present invention relates to a flotation device, and more particularly to a floating aluminum box that is reinforced on the inside and that can be thrown in the water in order to prevent a dock worker who falls in the water from getting crushed between two barges.

2. Description of the Related Art

Longshoremen, stevedores, sailors, dockyard workers and other personnel involved in the loading and unloading of cargo from marine vessels face considerable safety hazards. One of these hazards is that a person may fall into the water. Shipboard policy and oftentimes U.S. Coast Guard regulations dictate that a dock worker is required to wear a life jacket when working on deck. In addition, most ships, tug boats, and barges are equipped with life rings, fast rescue craft and other life saving devices, such as boat hooks, to retrieve a man who has fallen overboard.

Men and women who work in the loading and unloading of barges face an additional peril besides drowning if they fall in the water in a port servicing barges, such as being crushed by the barge as the barge is swayed out or in. A man overboard runs the risk of being crushed between two barges or being pinned between a barge and the quay. There is a need for a device that can be quickly thrown in the water in the vicinity of a man overboard and that will keep two barges apart while the man is pulled out of the water. A variety of flotation devices have been proposed for different purposes.

U.S. Pat. No. 6,273,774, issued Aug. 14, 2001 to Todd Robert Warzecha, shows an aquatic flotation device with easy mount and dismount. The flotation device is designed with two buoyant floats and a platform suspended between them. The platform rests below the surface of the water and allows an animal to easily mount the platform. U.S. Pat. No. 6,199,797, issued Mar. 13, 2001 to Michael G. Brown, teaches an aircraft float and system utilizing the same. The aircraft float is constructed of polyethylene but utilizes an internal box-like structure made of aluminum.

U.S. Pat. No. 4,517,911, issued May 21, 1985 to Wayne F. Seefeld, describes a flotation device. The flotation device utilizes two parallel pontoons fastened to a deck panel. The pontoons are of a substantially rectangular shape but are not reinforced with any inside support members.

U.S. Patent Publication No. 2002/0022417, published Feb. 21, 2002, (novel life-saving device); U.S. Pat. No. 3,785,312, issued Jan. 15, 1974 to Gordon L. Schneider (modular floating structure); U.S. Pat. No. 4,106,144, issued Aug. 15, 1978 to Bernard T. Chabot (sea rescue chamber and methods of constructing and utilizing same); U.S. Pat. No. 4,435,165, issued Mar. 6, 1984 to James E. Johnson (flotation device for supporting a person in water); U.S. Pat. No. 4,538,663, issued Sep. 3, 1985 to Robert Looker (cargo container); U.S. Pat. No. 4,926,781, issued May 22, 1990 to Martin G. Bauer (portable personal floatation device); U.S. Pat. No. 5,058,522, issued Oct. 22, 1991 to Martin G. Bauer (portable personal floatation device); U.S. Pat. No. 5,290,196, issued Mar. 1, 1994 to Brian V. Steel (inflatable float device); U.S. Pat. No. 5,853,264, issued Dec. 29, 1998 to Ronald Treveloni (bridge, dock and pier shoring-up bulk-delivery floating conveyor unit); U.S. Pat. No. 6,146,218, issued Nov. 14, 2000 to Robert D. White (universal platform for human powered floatation devices); U.S. Pat. No. 6,234,098 B1, issued May 22, 2001 to Baron R. Biedenweg et al. (extended width side rail for pontoon boat); and U.S. Pat. No. 6,413,134 B1, issued Jul. 2, 2002 to Michael Wahl et al. (life-saving device) disclose other flotation devices.

None of the above inventions and patents, taken either singly or in combination, is seen to describe the instant invention as claimed. Thus, a floating aluminum box to protect dockworkers solving the aforementioned problems is desired.

SUMMARY OF THE INVENTION

The floating aluminum box to protect dockworkers is an aluminum cube that can be dropped in to the water to prevent two barges from coming together so that a dockworker that has fallen in the water between two barges will not be crushed. The floating aluminum box is in the shape of a cube with each edge being approximately eighteen inches long. The floating aluminum box is watertight and made of quarter inch aluminum plate and is of welded construction.

The floating aluminum box has a front, back, two sidewalls, a top, and a bottom. The floating aluminum box has the internal support structure. The internal support structure comprises to two concentric aluminum pipes that have diameters of four inches and ten inches, respectively. The distal ends of the aluminum pipes are welded to the front and back of the cube. Welded to the pipes are a plurality of bracing plates that extend from the pipes to the sides of the cube. The concentric pipes and the bracing plates increase the rigidity of the floating aluminum box so that it may withstand the shock of two floating barges coming together and thereby create enough space between two barges for a worker who has fallen in the water to avoid being crushed.

The floating aluminum box is also equipped with a handle positioned in the center of the top of the box suitable for manual lifting. Two eye brackets are welded on the side of the box so that line may be attached. Optionally, where the front side meets the inner concentric pipe the front plate may be recessed so as to allow a hand hold equipped with a piece of bar stock to allow for manual lifting of the floating aluminum box.

Accordingly, it is a principal object of the invention to prevent a dockworker that falls between two barges from being crushed.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
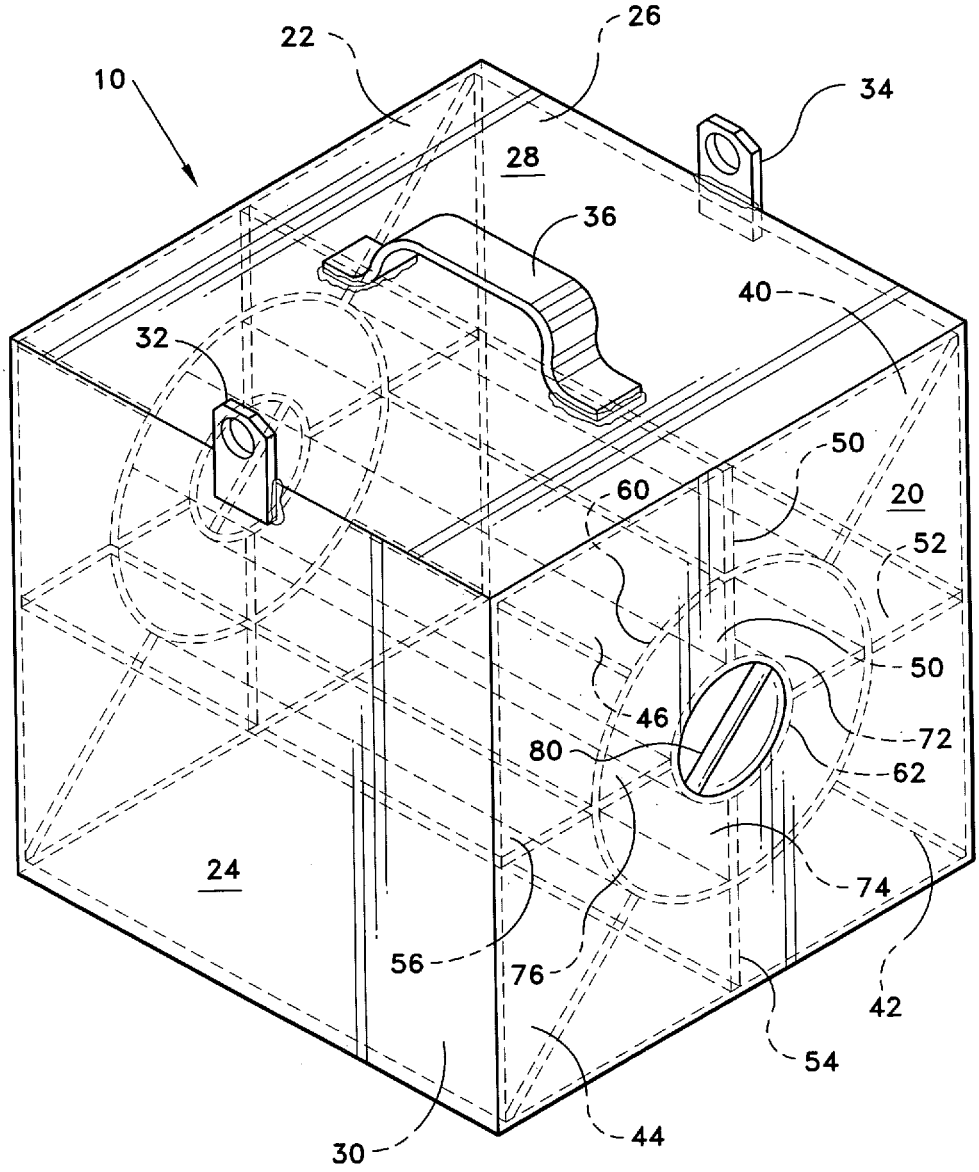
FIG. 1 is a perspective view of a floating-aluminum box to protect dockworkers, the internal support structure being shown in phantom.

The present invention is a floating aluminum box to protect dockworkers, designated generally as 10 in the drawings. The floating aluminum box 10 is in the shape of a cube and in the preferred embodiment each edge of the cube is eighteen inches long. The floating aluminum box 10 has a front wall 20, a back wall 22, two sidewalls 24, 26, a top wall 28 and a bottom wall 30. The floating aluminum box 10 is made of aluminum plate, is of welded construction, and is watertight. Aluminum or aluminum alloys are the preferred material in the present invention because of their low density, high strength to weight ratio, and corrosion resistance, which is particularly important in a marine environment. Aluminum alloys have good weldability characteristics using inert gas arc welding that also add to their desirability as a material in the present invention.

The top 28 of the floating aluminum box 10 is equipped with a handle 36 located approximately in the center of the top 28, as shown in FIGS. 1–4. Handle 36 is attached to the top 28 by welding, riveting or other attaching means. The floating aluminum box 10 can be manually lifted and transported by handle 36. Eye brackets 32, 34 are attached to the sidewalls 24, 26 so that the upper portion of the eye brackets 32, 34 protrudes above the edge of the sidewalls 24, 26. Rope or line may be threaded through the eyes in the eye brackets 32, 34 for use as a handle or retrieval line. Eye brackets 32, 34 are made of aluminum and are attached to the sidewalls 24, 26 by welding, riveting or other attaching means.

The floating aluminum box 10 has an internal support structure that comprises two concentric pipes 60, 62 extending between the front wall 20 and back wall 22 and bracing plates 40, 42, 44, and 46 extending diagonally between outer pipe 60 and the four front-to-back edges of the box 10, bracing plates 50, 52, 54, and 56 extending orthogonally between top wall 28, bottom wall 30, and sidewalls 24, 26 and the outer pipe 60, and bracing plates 70, 72, 74, and 76 extending between outer pipe 60 and inner pipe 62 coplanar with bracing plates 50–56. The inner concentric pipe 62 has a diameter of approximately four inches. Outer concentric pipe 60 is a ten-inch diameter aluminum pipe. The pipe and bracing plate structure increases the rigidity of the floating aluminum box 10 so that it can keep two floating barges apart, thereby providing space for a dockworker who has fallen between two barges to avoid being crushed.

Figure 2:
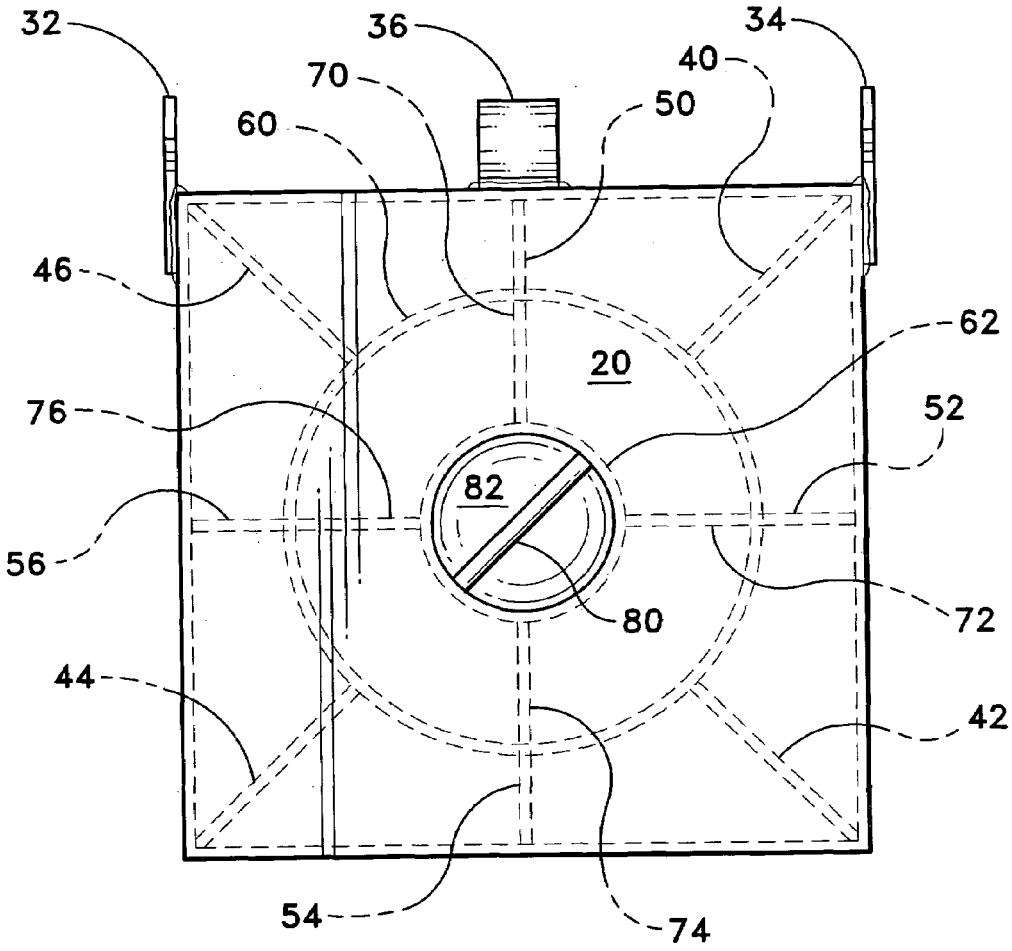
FIG. 2 is a front view of the floating aluminum box according to the present invention.
Figure 3:
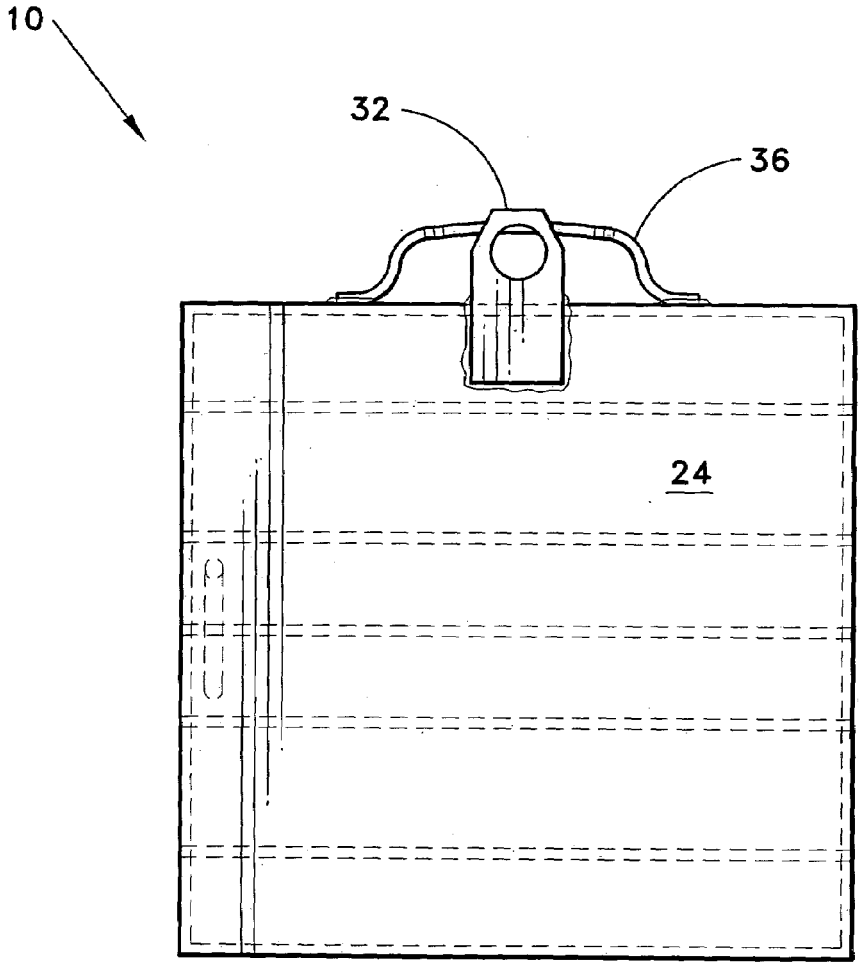
FIG. 3 is a side view of the floating aluminum box according to the present invention.
Figure 4:
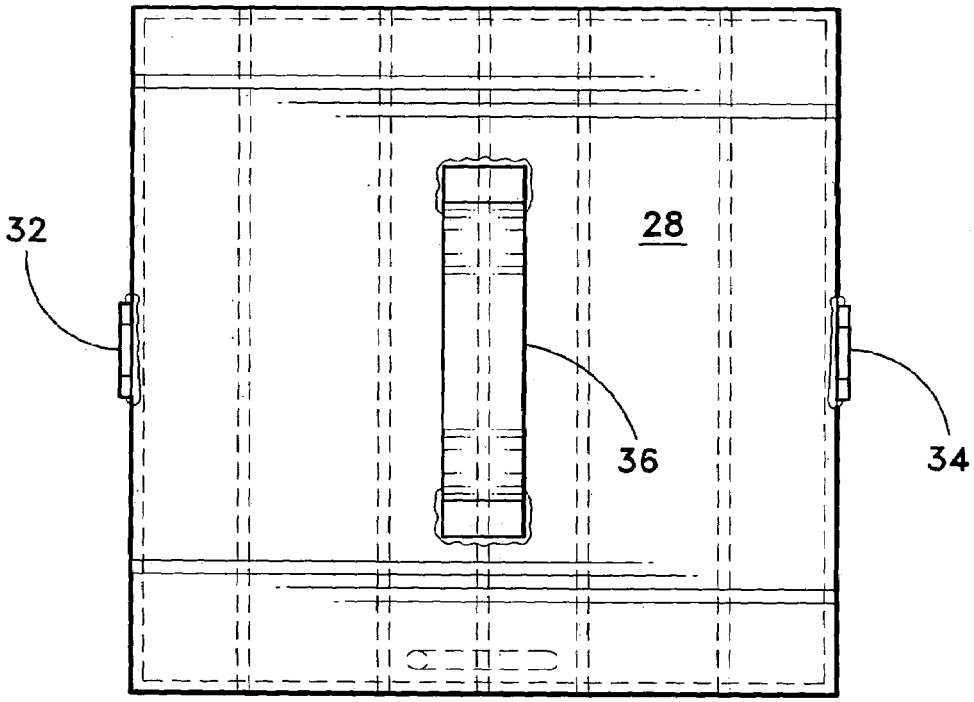
FIG. 4 is a top view of the floating aluminum box according to the present invention.

FIGS. 1 and 2 show the arrangement of the bracing plates. Bracing plate 40 extends from the outer surface of outer concentric pipe 60 to the intersection of the top 28 and sidewall 26. Bracing plate 42 extends from the outer surface of outer concentric pipe 60 to the intersection of bottom 30 and sidewall 26. Bracing plate 44 extends from the outer surface of outer concentric pipe 60 to the intersection of bottom 30 and sidewall 24. Bracing plate 46 extends from the outer surface of outer concentric pipe 60 to the intersection of top 28 and sidewall 24. Bracing plate 50 extends from the outer surface of outer concentric pipe 60 to the centerline of top 28. Bracing plate 52 extends from the outer surface of outer concentric pipe 60 to the centerline of sidewall 26. Bracing plate 54 extends from the outer surface of outer concentric pipe 60 to the centerline of bottom 30. Bracing plate 50 extends from the outer surface of outer concentric pipe 60 to the centerline of top 28.

The preferred embodiment also has a recessed hand hold 82 on the front 20 that is aligned with the inner concentric pipe 62. Recessed handhold 82 has a bar 80 spanning the diameter of inner concentric pipe 62. Recessed hand hold 82 and bar 80 provide an additional means of lifting or hoisting the floating aluminum box 10.

It is to be understood that the present invention is not limited to the embodiment described above, but encompasses any and all embodiments within the scope of the following claims.

I claim:

1. A floating aluminum box to protect dock workers, comprising:

a watertight cube having a front wall, back wall, two opposing sidewalls extending between the front and back walls, top wall and a bottom wall;

an inner pipe extending between the front and back walls;

an outer pipe concentrically disposed around the inner pipe extending between the front and back walls;

a first plurality of bracing plates extending radially outward between the inner pipe and the outer pipe;

a second plurality of bracing plates extending radially outward between the outer pipe and the walls of the cube.

2. The floating aluminum box according to claim 1, further comprising a handle attached to the top wall of the cube.

3. The floating aluminum box according to claim 1, further comprising two eye brackets attached to the two sidewalls and extending above the top wall of the cube.

4. The floating aluminum box according to claim 1, wherein each of the walls of the cube has a length of about eighteen inches.

5. The floating aluminum box according to claim 1, wherein the cube is constructed of ¼" thick aluminum plate.

6. The floating aluminum box according to claim 1, wherein the inner pipe has a diameter of about four inches.

7. The floating aluminum box according to claim 1, wherein the outer pipe has a diameter of about ten inches.

8. The floating aluminum box according to claim 1, wherein the first plurality of bracing plates and the second plurality of bracing plates are ¼" thick aluminum plate.

9. The floating aluminum box according to claim 1, wherein the front wall of the cube has a recess defined therein concentric with the inner pipe in order to form a handhold.

10. The floating aluminum box according to claim 9, further comprising a bar spanning the recess adapted for use as a handle.

11. A method of protecting dockworkers that have fallen between two barges using the floating aluminum box of claim 1, comprising the step of placing the box in water between the two barges.

* * * * *